US008118199B2

(12) United States Patent
Wilbur

(10) Patent No.: US 8,118,199 B2
(45) Date of Patent: Feb. 21, 2012

(54) DISPOSABLE DISPENSER

(76) Inventor: Todd Wilbur, Las Vegas, NV (US)

( * ) Notice: Subject to any disclaimer, the term of this patent is extended or adjusted under 35 U.S.C. 154(b) by 919 days.

(21) Appl. No.: 11/358,516

(22) Filed: Feb. 22, 2006

(65) Prior Publication Data

US 2007/0194042 A1 Aug. 23, 2007

(51) Int. Cl.
*A47G 19/24* (2006.01)
*B65D 47/00* (2006.01)
*B65D 35/00* (2006.01)

(52) U.S. Cl. ..... 222/565; 222/541; 222/107; 222/17; 383/86; 383/122; 383/119; 383/43; 229/219; 229/103.11; 229/115; 229/117.34; 229/17.32; 229/158; 229/240; 206/390; 403/404; 221/65

(58) Field of Classification Search ..... 383/86, 383/122, 119, 43; 229/219, 103.11, 115, 229/117.32, 117.34, 158, 240; 206/390; 222/541, 565, 107, 17; 403/404; 221/65
See application file for complete search history.

(56) References Cited

U.S. PATENT DOCUMENTS

| | | | | | |
|---|---|---|---|---|---|
| 303,760 | A | * | 8/1884 | Brainard | 56/393 |
| 490,680 | A | * | 1/1893 | Roberts | 229/116 |
| 506,982 | A | | 10/1893 | Diamond | |
| 571,512 | A | * | 11/1896 | Davidson | 229/112 |
| 742,271 | A | * | 10/1903 | Allen | 222/565 |
| 928,423 | A | | 7/1909 | Belson | |
| 1,087,469 | A | | 2/1914 | Stern | |
| 1,123,010 | A | * | 12/1914 | Richardson | 383/122 |
| 1,303,138 | A | | 5/1919 | Woolwine | |
| 1,717,367 | A | | 6/1929 | Byrne | |
| 1,729,213 | A | * | 9/1929 | Ford | 222/565 |
| D91,023 | S | | 11/1933 | Ellsworth | |
| 1,983,685 | A | | 12/1934 | Townsley | |
| 2,002,485 | A | | 5/1935 | Alfred | |
| 2,003,600 | A | | 6/1935 | Lowenfels | |
| 2,010,863 | A | | 8/1935 | Johnson | |
| 2,020,680 | A | | 11/1935 | Forrer | |
| 3,388,836 | A | | 6/1936 | Otto et al. | |
| 2,071,745 | A | | 2/1937 | Higginbottom | |
| 2,217,142 | A | | 10/1940 | Stedman | |
| RE22,490 | E | | 5/1944 | Rambold | |
| 2,349,589 | A | | 5/1944 | Harrington | |
| 2,360,415 | A | | 10/1944 | Gilbert | |
| 2,499,313 | A | | 2/1950 | Hoag | |
| 2,647,681 | A | | 8/1953 | Paoli | |
| 2,895,606 | A | | 7/1959 | Hoag | |
| 2,935,192 | A | | 5/1960 | DeMillion-Czamecki | |
| 2,935,238 | A | * | 5/1960 | Koehler | 229/116 |
| 2,946,496 | A | | 7/1960 | Stagmeier | |
| 2,956,710 | A | | 10/1960 | O'Conner | |
| 3,096,921 | A | | 7/1963 | Graybill | |
| 3,154,239 | A | | 10/1964 | Madsen | |
| 3,239,110 | A | * | 3/1966 | Buter | 222/465.1 |
| 3,263,863 | A | | 8/1966 | Hoag | |
| 3,301,466 | A | | 1/1967 | Perino et al. | |

(Continued)

*Primary Examiner* — Gene O. Crawford
*Assistant Examiner* — Rakesh Kumar
(74) *Attorney, Agent, or Firm* — Breneman & Georges

(57) ABSTRACT

A collapsible dispenser for dispensing various edible and non-edible materials in an industrial or home environment. More particularly, the invention pertains to a foldable and generally pyramoidal-shaped dispenser particularly suited to dispensing granular, powdered or viscous liquid materials and includes a dispenser body having a dispensing end and an interior compartment for receiving and storing various materials. The dispenser body includes a foldable base that may be manually manipulated between a collapsed position closing and sealing a dispensing mechanism and an expanded position opening and unsealing the dispensing mechanism for use.

22 Claims, 4 Drawing Sheets

U.S. PATENT DOCUMENTS

| | | | | | |
|---|---|---|---|---|---|
| 3,308,996 | A | | 3/1967 | Beck | |
| 3,366,229 | A | | 1/1968 | Sanni | |
| 3,453,661 | A | | 7/1969 | Repko | |
| 3,469,743 | A | | 9/1969 | Becker | |
| 3,473,650 | A | | 10/1969 | Hoag | |
| 3,482,760 | A | | 12/1969 | Boehm et al. | |
| 3,545,668 | A | | 12/1970 | Hultberg | |
| 3,557,853 | A | | 1/1971 | Jones | |
| 3,565,328 | A | | 2/1971 | Hudson | |
| 3,567,074 | A | * | 3/1971 | Brown | 222/107 |
| 3,834,113 | A | | 9/1974 | Howe et al. | |
| 3,888,163 | A | * | 6/1975 | Watanabe | 493/85 |
| 3,931,916 | A | * | 1/1976 | Blue et al. | 222/465.1 |
| 4,142,667 | A | | 3/1979 | Runo | |
| 4,168,003 | A | | 9/1979 | Wysocki | |
| 4,192,420 | A | | 3/1980 | Worrell, Sr. et al. | |
| 4,486,187 | A | * | 12/1984 | Foster | 493/194 |
| 4,557,385 | A | * | 12/1985 | Robinson | 383/200 |
| 4,576,316 | A | * | 3/1986 | Foster | 222/541.6 |
| 4,638,911 | A | | 1/1987 | Prohaska | |
| 4,644,732 | A | | 2/1987 | Morton | |
| 4,650,078 | A | | 3/1987 | Desmond et al. | |
| 4,706,875 | A | | 11/1987 | Blackman | |
| 4,732,315 | A | | 3/1988 | Gunn | |
| 4,799,594 | A | | 1/1989 | Blackman | |
| D304,300 | S | | 10/1989 | Duke | |
| 4,871,265 | A | * | 10/1989 | Peck | 383/89 |
| 4,909,395 | A | | 3/1990 | Weissman | |
| D311,664 | S | | 10/1990 | Stevens, Jr. | |
| 5,083,680 | A | * | 1/1992 | Plough | 222/142.1 |
| D361,262 | S | | 8/1995 | Lusker | |
| 5,452,850 | A | * | 9/1995 | Allsop | 229/219 |
| 5,478,153 | A | | 12/1995 | Feldkamper | |
| D376,501 | S | | 12/1996 | Spaseska | |
| 5,630,544 | A | | 5/1997 | Shane | |
| D380,964 | S | | 7/1997 | Miller et al. | |
| 5,709,479 | A | * | 1/1998 | Bell | 383/209 |
| D391,117 | S | | 2/1998 | Law et al. | |
| D396,002 | S | * | 7/1998 | Bell | D9/707 |
| 5,785,428 | A | * | 7/1998 | Mazzocchi | 383/103 |
| D398,429 | S | | 9/1998 | LeBlanc et al. | |
| D402,544 | S | | 12/1998 | Jones | |
| 6,048,100 | A | * | 4/2000 | Thrall et al. | 383/86 |
| 6,102,568 | A | | 8/2000 | Davis | |
| 6,126,318 | A | * | 10/2000 | Bell | 383/209 |
| D442,083 | S | | 5/2001 | Hoffman et al. | |
| D445,434 | S | | 7/2001 | Doornhein | |
| 6,311,872 | B1 | | 11/2001 | Bongiovanni | |
| 6,338,572 | B1 | * | 1/2002 | Schneck | 383/205 |
| 6,375,037 | B1 | * | 4/2002 | Bell et al. | 222/1 |
| 6,403,136 | B1 | | 6/2002 | Damm Bokobza | |
| D464,532 | S | | 10/2002 | Mantilla | |
| D471,762 | S | | 3/2003 | McClaskey et al. | |
| D483,261 | S | | 12/2003 | Stanley | |
| D494,859 | S | | 8/2004 | Keberlein | |
| D529,815 | S | | 10/2006 | Frasier et al. | |
| 7,264,119 | B2 | * | 9/2007 | Navickas | 206/390 |

* cited by examiner

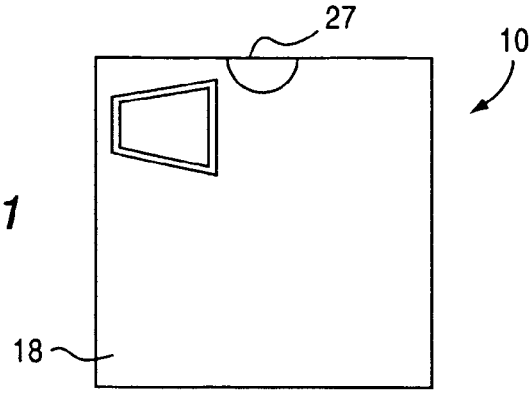
FIG. 1
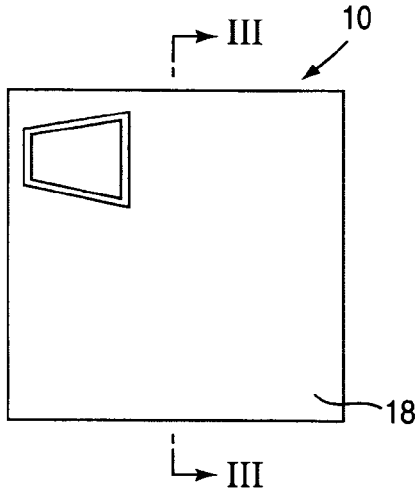
FIG. 2
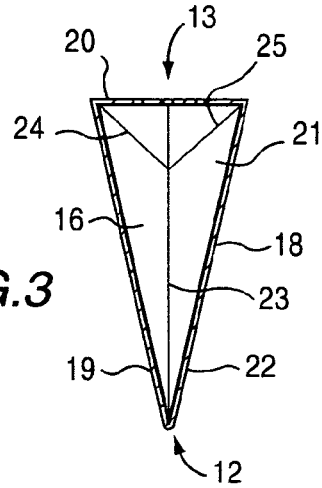
FIG. 3
FIG. 4A
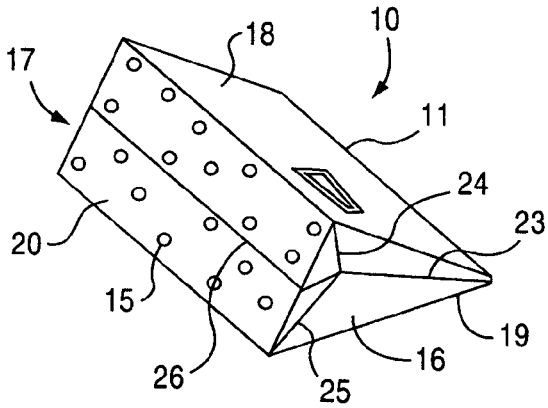
FIG. 4B
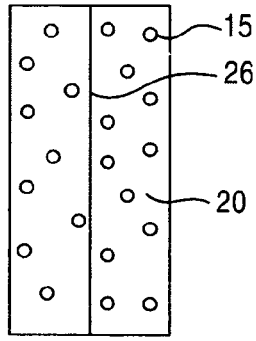

DISPOSABLE DISPENSER

BACKGROUND OF THE INVENTION

1. Field of the Invention

The invention relates generally to a foldable, flat generally two dimensional container and expandable to a three dimensional dispenser for dispensing materials in an industrial or home environment. More particularly, the invention pertains to a foldable generally pyramoidal-shaped dispenser particularly suited to dispensing granular, powdered or viscous liquid materials.

2. Description of the Related Art

Conventional disposable seasoning dispensers typically take the form of substantially flat packets composed of a paper or similar material having an interior compartment or chamber for storing seasonings, condiments or other materials. Such dispensers are generally not foldable and have many short-comings, particularly, in the manner in which the dispenser is manipulated by a user to dispense the contents from the packet. For example, many dispensers require ripping, tearing or shearing of an edge portion of the dispenser to release the contents. This method results in the pouring of streams of material from the dispenser in one concentrated area. Moreover, due to not having a resealable construction, the dispenser in the prior art requires the complete depletion of contents therefrom. Such prior art dispensers also require complicated tamper proof seals that are expensive to produce and apply to condiment containers.

Dispensers used primarily for industrial purposes are generally tubular or otherwise cylindrical body having a single opening from which the material is dispensed via squeezing or shaking by a user. While the user may simply place a cap which is press fit over the opening in an attempt to seal the opening when the dispenser is not in use, the cap fails to serve as a proper seal. Moreover, since the body and the cap are typically composed of a molded polymeric material, the cap and/or body may become worn or defective over time, thereby creating mating surfaces and permitting the undesirable leakage of contents. Finally, the size of the dispenser does not permit it to be easily stored or transported in bulk.

Heretofore, none of the aforementioned prior art disposable dispensers incorporates a structure that permits sealing of dispenser opening(s) through the folding of the dispenser body.

The prior art also lacks such a dispenser that incorporates a structure which effectively and evenly distributes its contents.

SUMMARY OF THE INVENTION

Accordingly, it is an object of the invention to provide a disposable dispenser for storing and dispensing liquid granular, powdered or viscous liquid materials in an industrial or home environment that can be easily manipulated by a user to a folded substantially two dimensional configuration for purposes of storage and shipment and expanded to a substantially three dimensional configuration for purposes of filling, refilling, dispensing or use. Such items may include edible materials such as seasonings, herbs, spices, mustard, ketchup and combinations thereof or non-edible materials such as paints, glues, industrial powders and liquids and the like.

It is another object of the invention to provide a reusable dispenser that does not require the complete emptying of contents therefrom.

While another object of the invention to provide a reusable dispenser which is resealable at respective filling and dispensing ends.

It is yet another object of the invention to provide a dispenser that is both reusable and refillable.

Yet and still another object of the invention to provide a disposable dispenser adaptable to permit the even distribution of materials therefrom in a sprinkle-type manner.

It is a further object of the invention to provide a dispenser having a robust structure that withstands buckling during a dispensing sequence.

While a further object of the invention is to provide a dispenser having a simplistic and economical construction.

Yet and still a further object of the invention is to provide a dispenser structured to prevent unwanted spilling or leaking of materials.

It is an additional object of the invention to provide a foldable container having a tamper indication seal.

While an additional object of the invention to provide a foldable container with an easily applied tamper indicator seal and a second seal for sealing the container.

These and additional objects are achievable in an exemplary embodiment of the invention in which a disposable dispenser is provided for storing and dispensing various materials, the dispenser including a foldable dispensing side having at least one dispenser opening disposed intermediate the ends of the foldable dispensing side, and at least two connector sides connected to the foldable dispensing side to form a dispensing compartment, at least one of the connector sides being foldable for folding with the foldable dispensing side to cooperate with the foldable dispensing side to fold into a flat dispenser for display or shipping and to unfold for use and expose the at least one dispenser opening for use.

In accordance with this embodiment, the at least one conduit dispenser opening may take the form of a plurality of dispenser apertures or openings while the at least three connector sides may take the form of four connector sides to facilitate the folding and expanding of the dispenser when either in use or in storage.

Another aspect of the invention includes a foldable dispenser including a foldable base having at least one conduit dispenser opening, at least two substantially unfolded sides connected to the foldable base, and at least two foldable sides connected to the foldable base and foldably connected to the at least two substantially unfolded sides to form an interior compartment. A first seal located at the at least one dispenser opening and/or a second seal located at the dispensing end of the dispenser may be provided to prevent unwanted spilling of contents from the dispenser when not in use. The foldable base may be provided with a fold forming two base sections whereby a plurality of dispenser openings are provided which are axially symmetrical on the respective base sections along the length of the fold. Such an aspect is advantageous for forming a natural freshness seal since each base wall section combines to form a mating sealing interface when the base wall is folded inwardly, i.e., when the dispenser is placed by a user in a storage position.

The foldable dispensing side also can form the base of a three-dimensional pyramoidal-shaped dispenser when unfolded into a substantially three-dimensional configuration for use. The foldable dispenser and dispenser base can be shipped and displayed in a substantially flat or two-dimensional configuration bearing tamper-evident and/or tamper-proof and freshness seals. The first seal may be a tamper-proof or tamper-evident indicator seal while the second seal may be a tamper proof or freshness seal.

The foldable dispenser may take various geometric shapes or forms. For instance, in one aspect the foldable base, the at least two substantially unfolded sides and the at least two foldable sides combine to form a substantially three-dimensional pyramoidal-shaped container. Moreover, the dispenser may include at least one foldable interior wall or panel dividing the interior compartment into separate interior compartments. The novel foldable dispenser may also be folded to a substantially flat two-dimensional container having a substantially triangular or rectangular configuration.

A further aspect of the invention includes a dispenser including a dispenser body having at least one dispensing end, at least one interior compartment for receiving materials and at least one dispensing mechanism provided at the at least one dispensing end for dispensing the materials from the at least one interior compartment. In this aspect of the invention, the dispenser body is adapted for movement between a collapsed or folded position whereby the at least one dispensing mechanism is sealed and an expanded position whereby the at least one dispensing mechanism is unsealed to facilitate the dispensing of the materials from the at least one interior compartment.

Moreover, the dispenser body may be composed of flexible, non-porous materials, such as paper stock or aluminum foil. The at least one dispensing mechanism may take the form of two dispensing mechanisms provided at the at least one dispensing end. The at least one dispensing end may take the form of two dispensing ends provided on opposite ends of the dispenser body and the at least one dispensing mechanism may take the form of two dispensing mechanisms provided on a respective dispensing end of the dispenser body with corresponding dispensers folding over to seal respective dispenser openings.

In yet another aspect of the invention, a refillable dispenser is provided including a dispenser body having a dispensing end and an interior compartment adjacent to the dispensing end for receiving materials, the dispenser body adaptable for movement between a collapsed or folded position and an expanded position. In this aspect of the invention, the dispensing end includes a dispensing section moveable relative to the dispenser body between an open position facilitating a refilling of materials into the interior compartment and a closed position facilitating a dispensing of materials from the interior compartment.

Moreover, the dispenser section, which may be provided with at least one or a plurality of dispenser openings, is preferably pivotably moveable relative to the dispenser body while also releasably attached to the dispenser body via an attachment mechanism.

These and other objects, features and advantages of the invention will become more apparent from the following description when taken in conjunction with the detailed drawings that show, for purposes of illustration only, the preferred embodiments of the invention.

BRIEF DESCRIPTION OF THE DRAWINGS

The advantages of the invention will become more apparent to those skilled in the art in conjunction with the detailed description of the preferred embodiments of the invention, in which:

FIG. 1 shows a front view of a dispenser in a folded position with the tamper-evident safety seal engaged; and FIG. 2 shows the view of FIG. 1 with the tamper-evident safety seal removed;

FIG. 3 shows a side cut away view of FIG. 2 with the dispenser in an expanded position and a view of the interior coating;

FIGS. 4A & 4B show perspective and bottom views of a dispenser in an expanded position with the randomly positioned dispenser openings;

FIG. 12C shows the dispenser of FIGS. 12A and 12B in a folded substantially flat configuration.

DETAILED DESCRIPTION OF THE INVENTION

Figure 5A:
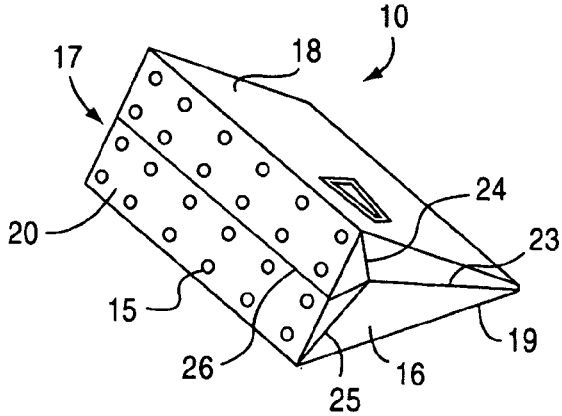
FIGS. 5A & 5B show perspective and bottom views of a dispenser in an expanded position with dispenser openings in axial and symmetrical alignment.

Referring now to drawing FIGS. 1-3 and 4A, which show in an exemplary embodiment of the invention, a collapsible, i.e., foldable and expandable, dispenser 10 having a collapsible dispenser body 11, a closeable filling end 12 and a foldable dispensing end 13 having at least one dispensing mechanism 14 for uniformly dispensing various edible and non-edible materials in an industrial or home environment. Such items may include edible materials such as seasonings, herbs, spices, mustard, ketchup and combinations thereof or non-edible materials such as paints, glues, industrial powders and liquids and the like.

As illustrated in FIG. 1, the upper edge of the dispenser 10 is secured or otherwise fastened and sealed by way of a tamper-evident safety tab or seal 27. The seal 27 is composed preferably of a lightweight paper or polymeric material having an adhesive backing for attaching the seal 27 at an uppermost edges of the dispenser body 11 adjacent the filling end 12. As shown in FIG. 8C, once the dispenser 10 is placed in an expanded position by a user, the uppermost edges of the dispenser body 11 may be opened to expose the interior compartment 21 for filling and/or refilling. Once the interior compartment 21 of the dispenser 10 is filled and/or refilled, the uppermost edges of the body 11 may subsequently be closed and resealed using the seal 27 or any comparable sealing device. An additional seal having the same or similar construction as seal 27 may be placed at the dispensing end 13 of the dispensing body 11 to prevent unwanted spilling or contamination of contents within the body 11. While a seal-type fastener having an adhesive backing is used in the embodiments of the invention, practice of the invention is not limited to this construction.

The dispenser body 11 includes a pair of side walls 16, 17, front and rear walls 18, 19 and a bottom or base wall 20 which combine to form the interior compartment 21 for receiving and storing condiments and the like. The upper edges of the walls 16, 17, 18, and 19 are secured and sealed by way of the seal 27, which contacts the outer surfaces of the front and rear walls 18, 19 to effectuate the sealing of the dispenser 10. As shown in FIG. 3, the inner surface or lining of the interior compartment 21 is preferably coated or laminated with an oil-resistant film 22 of suitable composition.

The dispenser body 11, which may also be disposable, is preferably composed of a flexible, non-porous, water-resistant material such as paper stock, plastic, foil or composite. However, any suitable packaging material known in the art having the aforementioned physical characteristics may be used in the alternative.

The dispenser 10 is foldable and expandable by way of left and right sidewalls 16, 17 having a longitudinal downfold line or indentation 23. The indentation 23 facilitates the folding or collapsing of the sidewalls 16, 17 when the dispensing body 11 is placed in the folded position for storage or shipping and the expansion of the sidewalls 16, 17 when the dispenser body 11 is placed in the expanded position. Once in the expanded position, the dispenser body 11 can be returned to its original folded position, thereby permitting it to be stored for shipping or display in small areas. The indentation 23 extends along a central axis of each respective sidewall 16, 17 from the filling end 12 to the dispensing end 13. Extending at a lower end of the indentation line 23 in an area adjacent the dispensing end 13 is a pair of transverse cuts 24, 25 which terminate at the bottom corner where the sidewalls 16, 17 intersect the base wall 20. A third indentation 26 is also provided at the base wall 20 and extends along a central axis of the base wall 20. The indentation 26 facilitates the folding or collapsing of the base wall 20 when a user places the dispensing body 11 in the folded position and the expansion of the base wall 20 when a user places the dispensing body 11 in the expanded position.

Figure 8A:
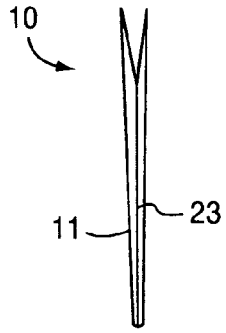
FIGS. 8A-8C show a diagrammatic view of a dispenser being moved between a folded position and an expanded position.
Figure 8B:
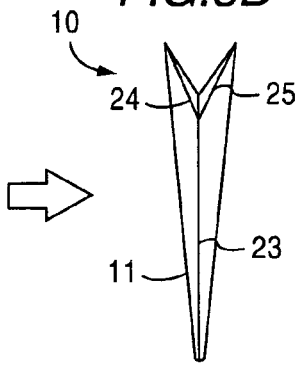
Figure 8C:
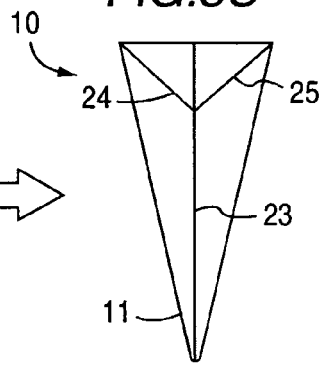

As best illustrated in FIGS. 8A-8C, the series of indentations 23, 24 & 25 help facilitate the manipulation of the dispenser body 11 between the folded position whereby the dispensing mechanism 14 is sealed and an expanded position whereby the dispensing mechanism 14 is exposed, thereby permitting the dispensing of materials from the interior compartment 21. When in the expanded position, the dispenser body 11 preferably takes a substantially pyramoidal-shape or configuration. However, the invention is not limited to any configuration, and thus, may take any geometric shape.

To optimize the overall dispensing action of the dispenser 10, the dispensing mechanism(s) 14 may have at least one or a plurality of dispensing apertures or openings 15 for uniformly dispensing the contents of the dispenser 10 in a sprinkle-type manner. These openings 15 extend from the outside surface of the base wall 20 into the interior compartment 21 and may be arranged across the surface of the base wall 20.

FIGS. 4A and 4B illustrate a novel arrangement whereby a plurality of dispenser openings 15 are randomly placed across the surface of the base wall 20. The arrangement of the dispenser openings 15 in this fashion is advantageous for at least uniformly dispensing contents of the dispenser 10 in a sprinkle-type manner while also providing enhanced structural integrity during dispensing. Particularly, the inventor has found that a dense packing of openings 15 along the base wall 20 causes undesirable creasing and/or buckling at the base wall 20 when attempting to manipulate the dispenser body 11 from the folded position to the expanded position.

Figure 5B:
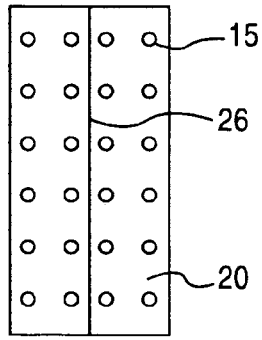

Illustrated in FIGS. 5A and 5B is an alternative arrangement whereby a plurality of dispenser openings 15 are equally provided on separate halves of the base wall 20. The openings 15 located on one half of the wall 20 are in axial and symmetrical alignment to the openings 15 located on the other half. This results in each opening 15 lining-up with a corresponding hole 15 on the other side of indentation 26 when the dispenser 10 is placed in a folded position. Such an arrangement of openings 15 is advantageous not only for permitting uniform dispensing, but also for forming a hermetic and natural tamper-proof safety seal at the base wall 20 when the dispenser 10 is placed in a folded position due to each base wall 20 section forming a sealing interface. The seal may be removed once the dispenser 10 is placed in the expanded position.

Figure 6A:
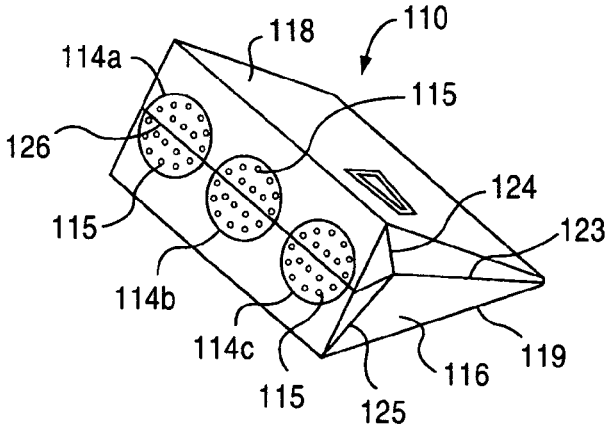
FIGS. 6A & 6B show perspective and bottom views of a dispenser in an expanded position with three dispensing mechanisms and interior compartments.
Figure 6B:
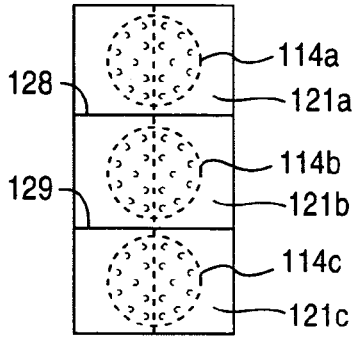

FIGS. 6A and 6B show yet another aspect of the invention which includes a dispenser 110 having a dispensing mechanism 114 with a plurality of dispensing sections 114*a*, 114*b* and 114*c*, each having a plurality of dispensing holes 115 for uniformly dispensing condiments in a sprinkle-type manner. Left sidewall (not shown) and right sidewall 116 each have a longitudinal downfold line or indentation 123 that facilitates the folding or collapsing of the sidewalls when the dispenser 110 is placed in a folded position for storage and the expansion of the sidewalls when the dispenser 110 is placed in the expanded position. A third indentation 126 facilitates the folding or collapsing of the dispensing end when the dispenser 110 is placed in the folded position and the expansion of the dispensing end when the dispenser 110 is placed in the expanded position.

In the embodiment illustrated in FIGS. 6A and 6B, the interior compartment 121 may also include vertical walls 128, 129 that separate the interior compartment 121 into separate compartments 121*a*, 121*b* and 121*c* which directly communicate with a respective dispensing section 114*a*, 114*b*, and 114*c*. This feature is advantageous in permitting a user to fill each interior compartment 121*a*, 121*b* and 121*c* with custom blends of herbs, spices and the like. While each dispensing section 114*a*, 114*b* and 114*c* is shown having a generally circular geometric shape, the practice of the invention is not limited to such a shape and may alternatively have various geometric shapes that permit the advantageous practice of the invention.

Figure 7A:
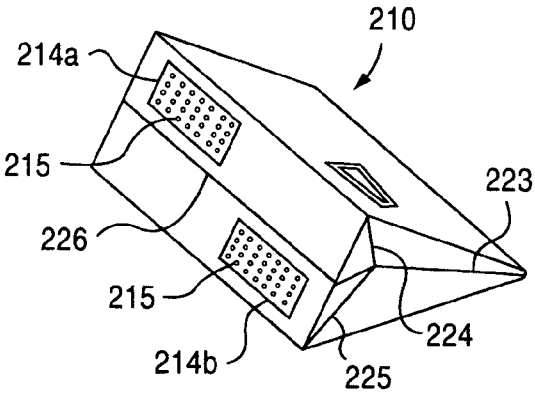
FIGS. 7A & 7B show perspective and bottom views of a dispenser in an expanded position with a pair of dispensing mechanisms and interior compartments.
Figure 7B:
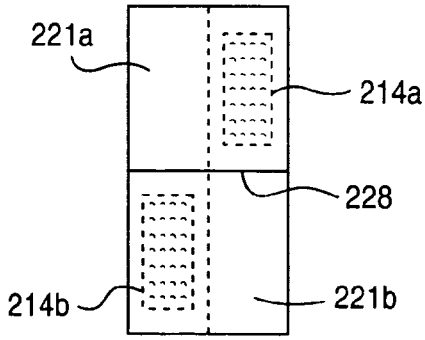

FIGS. 7A and 7B illustrates an embodiment similar to the embodiment shown in FIGS. 6A and 6B, particularly, a dispenser 210 having a dispensing mechanism 214 with a pair of dispensing sections 214*a* and 214*b*, each having a plurality of dispensing holes 215 for uniformly dispensing condiments in a sprinkle-type manner. Left sidewall (not shown) and right sidewall 216 each have a longitudinal downfold line or indentation 223 that facilitates the folding or collapsing of the sidewalls when the dispenser 210 is placed in a folded position for storage and the expansion of the sidewalls when the dispenser 210 is placed in the expanded position. A third indentation 226 facilitates the folding or collapsing of the dispensing end when the dispenser 210 is placed in the folded position and the expansion of the dispensing end when the dispenser 210 is placed in the expanded position.

In the embodiment illustrated in FIGS. 7A and 7B, the interior compartment 221 may also include a vertical wall 228 that separates the interior compartment 221 into separate sections 221*a* and 221*b* which directly communicate with a respective dispensing section 214*a* and 214*b*. While each dispensing section 214*a* and 214*b* is shown here having a generally rectangular geometric shape, the practice of the invention is not limited to such a shape and may alternatively have various geometric shapes that permit the advantageous practice of the invention.

FIGS. 8A-8C illustrate the phases in which the dispenser 10 may be used. Once the tamper-proof safety seal 27 is removed from the filling end 12 and/or dispensing end 14, the dispensing mechanism 14 may be spread open as a result of the series of indentations 23, 24, 25 and 26. The opening at the dispensing end 14 reveals the dispensing openings 15 while causing the left and right sidewalls 16, 17 to buckle, thereby locking the dispenser body 11 into the expanded position. The user can at this time uniformly dispensing condiments in a sprinkle-type manner over the intended article, then simply discard or fold the dispenser 10 into its original position for storage in any storage area.

Figure 9A:
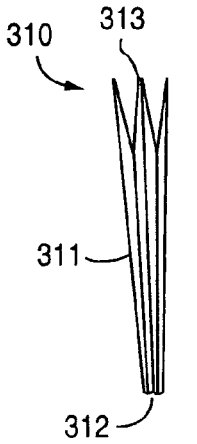
FIGS. 9A-9C show a diagrammatic view of a dispenser being moved between a folded position and an expanded position, the dispenser having dispensing ends located in series.
Figure 9B:
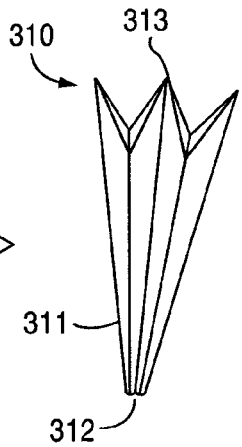
Figure 9C:
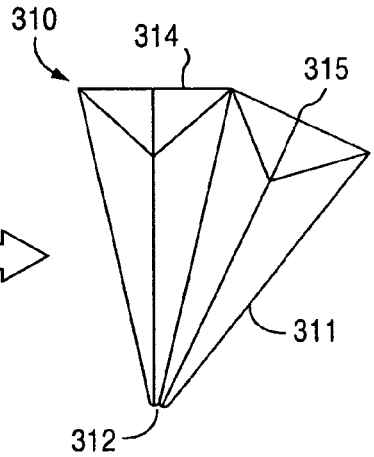

Illustrated in FIGS. 9A-9C is a further aspect of the invention which includes a dispenser 310 having a dispenser body 311 with a filling end 312 and a dispensing end 313. FIGS. 9A and 9B show the dispenser 310 with the sealed removed and being moved from its natural folded storage position to an expanded position while FIG. 9C shows the dispenser in a fully expanded dispensing position. The dispensing end 313 has a pair of dispensing mechanisms 314, 315 each having at least one or a plurality of dispensing apertures or openings (not shown). The dispensing mechanisms 314, 315 are arranged in series whereby each dispensing mechanism 314, 315 is located at the same dispensing end 313 to obtain simultaneous dispensing in greater quantities. Each dispensing mechanism 314, 315 may also have separable interior compartments (not shown) which permit the storage and dispensing of customized materials.

Figure 10A:
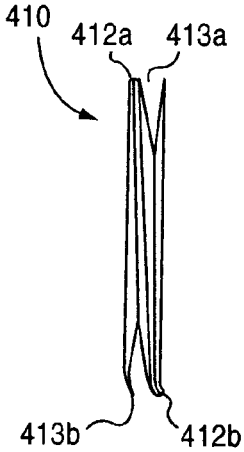
FIGS. 10A-10C show a diagrammatic view of a dispenser being moved between a folded position and an expanded position, the dispenser having dispensing ends located in parallel.
Figure 10B:
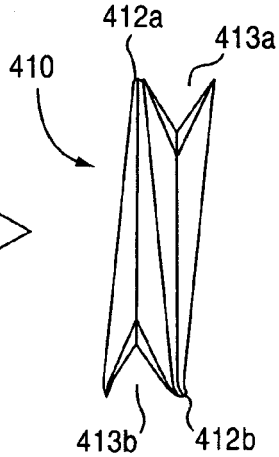
Figure 10C:
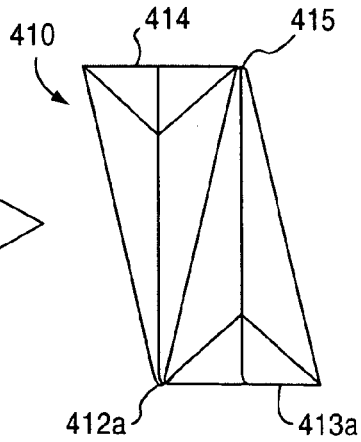

Illustrated in FIGS. 10A-10C is yet a further aspect of the invention which includes a dispenser 410 having a dispenser body 411 with a pair of filling ends 412*a* and 412*b* and a pair of dispensing ends 413*a* and 413*b*. FIGS. 10A and 10B show the dispenser 410, with the sealed removed, being manipulated from its natural folded position to an expanded position while FIG. 10C shows the dispenser in a fully expanded position. The dispensing ends 413*a* and 413*b* have respective dispensing mechanisms 414, 415 each having at least one or a plurality of dispensing apertures or openings (not shown). The dispensing mechanisms 414, 415 are arranged in parallel whereby each dispensing mechanism 414, 415 has separable dispensing ends 413*a*, 413*b* and interior compartments (not shown). The separable interior compartments permit the storage and dispensing of customized materials but does not permit simultaneous use of the dispenser mechanisms 414, 415.

Figure 11:
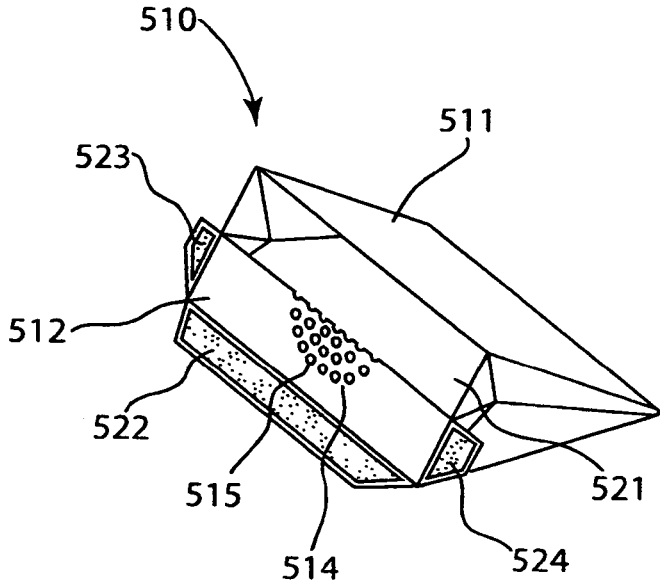
FIG. 11 shows a bottom perspective view of a refillable dispenser in an expanded position with the second dispensing section engaged in an open position in accordance with yet and still another embodiment of the invention.

FIG. 11 shows yet another aspect of the invention that includes a dispenser 510 having a dispenser body 511 expandable between a folded position and an expanded position. The dispenser body 511 has an interior compartment 521 for receiving and storing various materials and a multi-functional base wall for facilitating the filling, refilling and dispensing when the dispenser body 511 is in the expanded position. Such a feature is advantageous since it permits the user to fill the dispenser 510 with a custom blend of materials. The base wall has a dispensing mechanism 514 which includes or a plurality of dispenser openings 515 for uniform dispensing. Also provided on the base wall is a hinged section 512 which pivots or hinges relative to the dispenser body 511 between an open position exposing the interior compartment 521 to facilitate the filling and/or refilling of materials therein and a closed position to reveal the dispenser openings 515 and thereby facilitate the dispensing of materials. On the outer periphery of the hinged section 512 are main 522 and secondary attachment mechanisms 523, 524 which removeably attach the hinged section 512 to the dispenser body 511. Preferably an adhesive backing or comparable substance or backing is provided on the inner surface of each attachment mechanism 522, 523, and 524 to attach the hinged section 512 to the dispenser body 511.

Figure 12A:
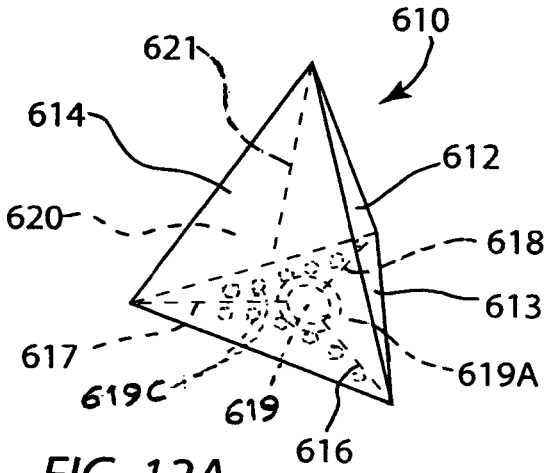
FIGS. 12A, 12B and 12C show perspective, bottom and side views of a dispenser in an expanded position having a generally triangular-pyramoidal shape with a single dispensing mechanism
Figure 12B:
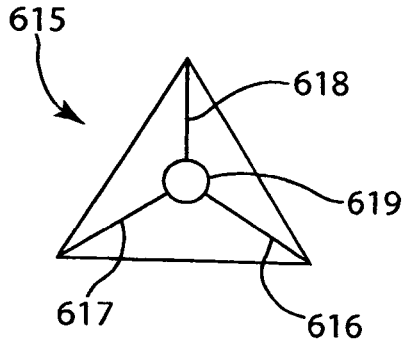
Figure 12C:
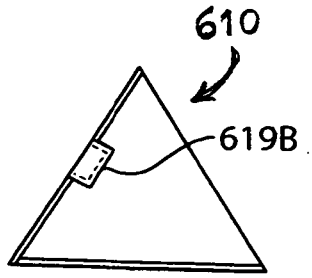

FIGS. 12A, 12B and 12C illustrate yet a further embodiment of a dispenser 610 that is most useful for dispensing various viscous fluid materials. The dispenser 610 is shown having a body 611 in the shape of a triangular pyramid, i.e., having three side or faces 612, 613 and 614, an interior compartment 620 for receiving viscous fluid materials and a fordable base 615. The body 611 is foldable and expandable by way of the foldable face 614 and foldable base 615. The base 615 has three downfold lines or indentations 616, 617, 618 which extend from a respective corner of the base 615 and terminate into a dispensing mechanism 619 located at a generally center most area of the base 615. The base 615 can optionally have a tamper proof seal 619A or have a plurality of dispensing openings 619C in lieu of the single dispensing mechanism 619. A single first tamper proof seal 619B may be used alone or with the optional tamper proof seal 619A. The foldable face 614 has a vertical line or indentation 621 which extends from the upper most section of the dispenser 610 to the edge of the face 614 that intersects the base 615. Each indentation 616, 617 and 618 facilitates the folding or collapsing of the base 615 inwardly towards the interior compartment 620 when the dispensing body 611 is placed in a folded position for storage, shipping or display. The indentation 621 facilitates the outward expansion of the face 614 such that the inner surfaces of respective halves of the face 614 directly abut one another in a coplanar relationship. During this sequence, the remaining faces 612 and 613 fold on top of each other to create a compact dispenser 610 in a folded flat triangular configuration as illustrated in FIG. 12C. The indentations 616, 617 and 618 also facilitate the expansion of the base 615 into its normal triangular form when the body 611 is placed in an expanded position, thereby exposing a dispensing mechanism 619 for use. Moreover, the indentation 621 permits the face to collapse inwardly to a flattened single triangular form. The dispenser 610 may be constructed in order to permit refilling of the body 611 by providing an opening at any area of at least one of the faces 612, 613, 614 or the base 615. A user may place the dispenser 610 in the collapsed or folded position by simply manipulating the base inwardly toward the top of the body 615 and returning to the expanded position by manipulating at least two of the faces 612, 613, 614 outwardly.

It is apparent that innumerable variations of the preferred embodiments described hereinbefore may be utilized. However, these as well as other variations are believed to fall within the spirit and scope of the invention as covered by the claims attached herein.

What is claimed is:

1. A disposable dispenser comprising:

(a) a foldable pyramoidal shaped dispenser having an apex at one end and a fold in a flat planar foldable base at the other end, said fold in said flat planar foldable base when unfolded forms a substantially flat planar dispensing base and which foldable pyramoidal shaped dispenser when folded forms a substantially flat four sided rectangular container;

(b) at least two dispensing openings disposed in said flat planar foldable base with said at least two dispensing openings closed when said flat planar foldable base is folded and opened when said flat planar foldable base is unfolded to dispense from said at least two dispensing openings in said substantially flat planar dispensing base and lock the foldable pyramoidal shaped dispenser into its fully open pyramoidal shape without having to maintain pressure on its two rectangular shaped sides or its two foldable connector sides and without said fold in said flat planar foldable base ever being separated, torn open or destroyed; and (c) two rectangular shaped sides and two foldable connector sides connected to said foldable base and said apex to form a foldable compartment for holding a condiment or food dispensable material, said two foldable connector sides having two first ends terminating at said apex and two second ends terminating at said flat planar foldable base and at said fold at said flat planar foldable base, said two second ends being foldable for folding with said flat planar foldable base to fold into a substantially flat planar dispenser for display or shipping and to unfold for use wherein said dispensable condiment or food material is disposed in said substantially flat four sided rectangular container and dispensed when said foldable pyramoidal shaped dispenser is in said fully open pyramoidal shape.

2. The dispenser of claim 1, wherein said at least two dispenser openings comprises a plurality of dispenser openings.

3. The dispenser of claim 1, further comprising a tamper evident seal to hold said flat planar foldable base and at least two foldable sides in a substantially flat configuration for display or shipping.

4. A foldable dispenser comprising:

(a) a foldable substantially flat triangular shaped dispenser having an apex at one end and a foldable and unfoldable base at the other end with a fold in the foldable and unfoldable base which when unfolded provides a substantially flat dispensing base;

(b) two substantially unfolded sides forming said apex and connected to said foldable and unfoldable base;

(c) one foldable side connected to said apex and said foldable and unfoldable base and foldably connected to said two substantially unfolded sides to form an interior compartment; and (d) a dispenser opening disposed in said foldable and unfoldable base with said dispenser opening closed when said foldable and unfoldable base is folded and said substantially flat triangular shaped dispenser is folded in a substantially flat triangular configuration and opened when said foldable and unfoldable base is unfolded to a pyramoidal shape to provide a substantially flat dispensing base and wherein said foldable and unfoldable base is folded and unfolded without tearing open said fold in said foldable and unfoldable base and wherein when unfolded said foldable and unfoldable base, said two substantially unfolded sides and said one foldable side forms a three dimensional substantially pyramoidal shaped container having three equilateral triangular sides and wherein a dispensable condiment or food is disposed in the dispenser in said substantially flat triangular configuration and dispensed when said substantially flat triangular shaped dispenser is unfolded to said pyramoidal shape.

5. The dispenser of claim 4, further comprising a tamper-evident seal for said dispenser opening.

6. The dispenser of claim 5, further comprising a tamper evident second seal for connecting ends of said foldable and unfoldable base.

7. The dispenser of claim 4, wherein said dispenser opening is a plurality of dispenser openings.

8. The dispenser of claim 7, wherein said fold is a triangular shaped fold provided on said foldable and unfoldable base and wherein said plurality of dispenser openings are axially symmetrical on opposing sides along the length of said triangular shaped fold.

9. A collapsible dispenser comprising:

a first collapsible pyramoidal shaped dispenser body having an interior compartment a first foldable, sealable and collapsible dispensing end with a first dispensing opening in said first foldable, sealable and collapsible dispensing end, said first dispensing opening having a plurality of first dispensing apertures, said first collapsible pyramoidal shaped dispenser body and said first foldable, sealable and collapsible dispensing end being adapted for movement between a folded position which closes and seals said first dispensing opening and an expanded position which opens and locks said first dispensing opening in an open position without maintaining pressure on said first collapsible dispenser body by having at least one foldable side with a plurality of triangular sections that meet at a point which folds inwardly into said interior compartment to close said first collapsible pyramoidal shaped dispenser and folds outwardly to lock said first collapsible pyramoidal shaped dispenser in its expanded position to facilitate a dispensing of contents stored in said body through said plurality of first dispensing apertures disposed in said first foldable, sealable and collapsible dispensing end which when unfolded forms a first substantially flat dispensing end;

a second collapsible pyramoidal shaped dispenser body having a second foldable, sealable and collapsible dispensing end with a second dispensing opening in said second sealable and collapsible dispensing end, said second dispensing opening having a plurality of second dispensing apertures, said second collapsible pyramoidal shaped dispenser body and said second foldable, sealable and collapsible dispensing end being adaptable for movement between a folded position which closes and seals said second dispensing opening and an expanded position which opens and locks said second dispensing opening in an open position without maintaining pressure on said second collapsible dispenser body by having at least one foldable side with a plurality of triangular sections that meet at a point which folds inwardly to close said first collapsible pyramoidal shaped dispenser and folds outwardly to lock said first collapsible pyramoidal shaped dispenser in its expanded position to facilitate a dispensing of contents through said second plurality of second dispensing apertures disposed in said second foldable, sealable and collapsible dispensing end which when unfolded forms a second substantially flat dispensing end; and wherein said first collapsible pyramoidal shaped dispenser body and said second collapsible pyramoidal shaped dispenser body are joined together along an unfoldable side and wherein a dispensable condiment or food is disposed in said first collapsible pyramoidal shaped dispenser body or said second collapsible pyramoidal shaped dispenser body and dispensed when a dispensing end is opened and said first collapsible pyramoidal shaped dispenser body or said second collapsible pyramoidal shaped dispenser body is opened and locked in its expanded position.

10. The dispenser of claim 9, wherein said collapsible dispenser body comprises a flexible, non-porous material.

11. The dispenser of claim 10, wherein said flexible, non-porous material comprises paper stock.

12. A foldable device for dispensing products comprising:

a foldable and unfoldable container foldable into a substantially flat two dimensional four sided rectangular configuration with a dispensable condiment or food disposed therein and unfoldable to an open position and locked into a substantially pyramoidal shaped dispenser for dispensing said dispensable condiment or food without having to maintain pressure on an inside side or an outside side of said substantially pyramoidal shaped dispenser by having two triangular shaped sides having four foldable triangular sections that meet at a point which folds inwardly to close the foldable and unfoldable container and folds outwardly to open and lock the foldable and unfoldable container into said fully open position, said foldable and unfoldable container having an apex end and a foldable and unfoldable base end, said foldable and unfoldable base end having a fold and a dispenser opening in said foldable and unfoldable base end, a lock on said foldable and unfoldable container formed by having two substantially rectangular shaped sides meeting to form said apex end and two triangular shaped sides connecting said two substantially rectangular shaped sides to said foldable and unfoldable base end, said two triangular shaped sides having ends terminating at said base end of said foldable and unfoldable container to fold perpendicular to said fold in said foldable and unfoldable base end, wherein said dispenser opening is opened and locked fully open without having to maintain pressure on an inside or an outside side of said foldable and unfoldable container when said foldable and unfoldable container is unfolded to form a substantially flat dispensing base surrounding said dispensing opening in a substantially pyramoidal shaped dispenser and said dispenser opening is closed when said foldable and unfoldable container is folded into a substantially flat rectangular configuration and said fold is folded and unfolded without separating or tearing said fold.

13. The foldable device of claim 12 wherein said foldable and unfoldable base end includes a tamper proof dispensing seal.

14. The foldable device of claim 12 wherein said dispensing opening includes a plurality of holes.

15. The foldable device of claim 12 wherein said foldable and unfoldable base end includes an adhesive on one or both sides of said fold to hold said foldable and unfoldable container in a folded substantially flat configuration.

16. The foldable device of claim 12 wherein said foldable and unfoldable container is constructed of a flexible, non porous water resistant material.

17. A fillable dispenser comprising:

(a) a substantially flat foldable pyramoidal shaped dispenser having an apex at one end and a fold in a foldable base at the other end which fold when unfolded forms a substantially flat planar dispensing base and which pyramoidal shaped dispenser when folded closed forms a substantially flat four sided rectangular container having an interior compartment;

(b) a lock on said pyramoidal shaped dispenser formed by two rectangular shaped sides and two foldable triangular shaped connector sides connected to said foldable base and said apex to form a foldable compartment for holding a dispensable food or condiment material, said two foldable triangular shaped connector sides each having four foldable triangular sections that meet at a point that folds inwardly and inside said interior compartment to close said foldable base and folds outwardly to lock the pyramoidal shaped dispenser into its fully open pyramoidal shape; and (c) at least one dispensing opening in said foldable base with said at least one dispensing opening closed when said foldable base is folded and opened when said foldable base is unfolded to form a flat planar base to dispense from said at least one dispensing opening in said substantially flat dispensing base and lock the foldable pyramoidal shaped dispenser into its fully open pyramoidal shape without having to maintain pressure from the inside or from the outside on its two rectangular shaped sides or its two foldable connector sides wherein said dispensable food or condiment material is dispensable when said foldable pyramoidal shaped dispenser is fully opened and locked into said fully open pyramoidal shape.

18. The fillable dispenser of claim 17 wherein said dispensing base includes a plurality of connector tabs.

19. The fillable dispenser of claim 18 wherein said plurality of connector tabs include an adhesive.

20. The fillable dispenser of claim 17 further comprising a plurality of connector tabs designed to seal to at least one of said four foldable triangular sections.

21. The fillable dispenser of claim 20 wherein at least one of said plurality of connector tabs are designed to seal to at least one of said two rectangular shaped sides.

22. The fillable dispenser of claim 20 wherein at least two of said plurality of connector tabs are designed to seal to at least two foldable triangular sections.

* * * * *